United States Patent [19]

McNeill et al.

[11] 3,943,404

[45] Mar. 9, 1976

[54] HELICAL COUPLER FOR USE IN AN ELECTRODELESS LIGHT SOURCE

[75] Inventors: William Henry McNeill, Carlisle; Paul Osborne Haugsjaa, Acton; Robert James Regan, Needham; Joseph Martin Lech, Westford, all of Mass.

[73] Assignee: GTE Laboratories Incorporated, Waltham, Mass.

[22] Filed: Apr. 21, 1975

[21] Appl. No.: 570,110

[52] U.S. Cl. ..... 315/39; 315/248

[51] Int. Cl.[2] ..... H01J 61/56

[58] Field of Search ..... 315/39, 248, 267, 344; 313/182

[56] References Cited

UNITED STATES PATENTS 3,787,705 1/1976 Bolin et al. ..... 315/248

*Primary Examiner*—R. V. Rolinec

*Assistant Examiner*—Darwin R. Hostetter

*Attorney, Agent, or Firm*—Irving M. Kriegsman; Leslie J. Hart

[57] ABSTRACT

A termination fixture for exciting an electrodeless lamp with high frequency power matches a capacitive complex impedance of the lamp in an excited state to the output impedance of the high frequency source coupled to the fixture. The fixture has a pair of coaxial conductors which have a length of one quarter wavelength and which have a ratio of diameters effective to match the real impedance of the lamp to the impedance of the source. A helical coil couples the end of the inner conductor to the lamp. The purpose of the coil is to make the impedance of the lamp, as viewed, electrically, from the end of the inner conductor appear as having only the real component. The quarter wave fixture then matches the real impedance to the source impedance.

9 Claims, 7 Drawing Figures

HELICAL COUPLER FOR USE IN AN ELECTRODELESS LIGHT SOURCE

BACKGROUND OF THE INVENTION

The present invention relates to electrodeless light sources and, more particularly, to such sources which are excited by high frequency power, such as in the range of 100 MHz to 300 GHz.

There have been, historically, three basic methods of exciting discharges without electrodes. The first method uses the discharge as a lossy part of either the capacitance or inductance of a "tank" circuit. This method is used to advantage only at frequencies where the dimensions of the lamp are much smaller than the wavelength of excitation. Also, in this method, there are power losses due to radiation and shifts in frequency upon start-up. A second method of exciting electrodeless lamps with microwave power is to place the lamp in the path of radiation from a directional antenna. However, since free propagation of microwave power occurs, there is an inherent inefficiency and some of the power is scattered thereby endangering persons in the area.

A third method uses a resonant cavity which contains the lamp, a frequency tuning stub and a device for matching the lamp-cavity impedance to that of the source and transmission line. Examples of devices according to this method may be found in "Microwave Discharge Cavities Operating at 2450 MHz" by F. C. Fehsenfield et al., Review of Scientific Instruments, Volume 36, Number 3, (March, 1965). This publication describes several types of tunable cavities. In one type, cavity No. 5, the discharge cavity transfers power from the source to the lamp, and the resonant structure of the cavity increases the electric field in the gas of the lamp. The presence of a discharge in the resonator changes the resonant frequency and also changes the loaded Q factor. Therefore, it is necessary to provide both tuning (frequency) and matching (impedance) adjustments to obtain efficient operation over a wide range of discharge conditions. The tuning stub is first adjusted for a minimum reflected power with the minimum probe penetration. Next, the probe (impedance) is adjusted. Since these two operations are not independent, successive readjustments are required to achieve optimum efficiency.

All of these tunable cavities have features which make them less than ideally suited for use in an electrodeless light source. To make cavity type systems useful economically, the cavity must be small enough so that it would be feasible to use such systems in place of the conventional electrode-containing lamp. Resonant cavities are too large and must be larger if lower microwave frequencies are used. One resonant cavity for 2450 MHz operation has four inches as its greatest dimension; the size would be even larger for operation at 915 MHz which is a standard microwave frequency for consumer use, such as with microwave ovens. Operation at this lower frequency is also advantageous from the view that the greater the frequency the more expensive the microwave power source becomes. The known tunable cavity has a less than optimum shape because the lamp is substantially enclosed by the resonant cavity housing, thereby impeding the transmission of light.

SUMMARY OF THE INVENTION

According to the present invention, an electrodeless light source is provided in which the problems previously mentioned have been overcome. The light source includes a termination fixture which is coupled to a source of high frequency power. The fixture has an inner conductor and an outer conductor disposed around the inner conductor. These conductors have lengths of a quarter wavelength and cross-sectional dimensions selected to produce a fixture characteristic impedance which matches the real component of the complex impedance of an electrodeless lamp, which forms a termination to the conductors, to the impedance of the coupled source. The fixture includes a reactive impedance device which is coupled between the outer end of the inner conductor and the lamp. This device compensates for the reactive component of the complex impedance of the termination when the lamp is in the excited state. Usually, the reactive component of the lamp impedance is capacitive so that the compensating device is an inductance in series between the inner conductor and the lamp. Preferably, the inductance is a helical coil.

In the present invention, it is possible to obtain a perfect impedance match, despite the load impedance being complex. The compensating coil reduces fixture losses since the largest standing waves are confined to the lamp-coupler region. Also, the coil is a high thermal resistance element by virtue of its length and cross-section, thus reducing heat conduction losses from the lamp.

DESCRIPTION OF PREFERRED EMBODIMENTS

Figure 2:
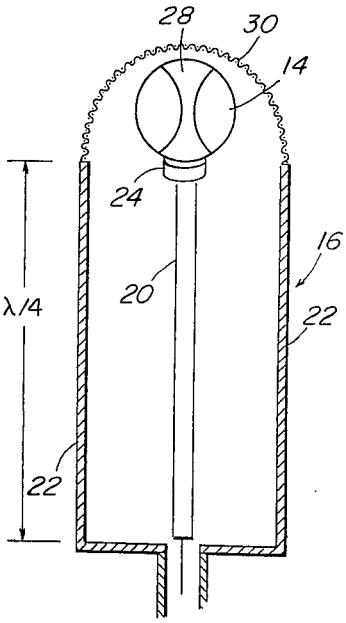
FIG. 2 is a diagram of the quarter wavelength fixture and illustrating the lamp arc in the excited state and various components involved in determining impedance quantities in the fixture and lamp combination.
Figure 5:
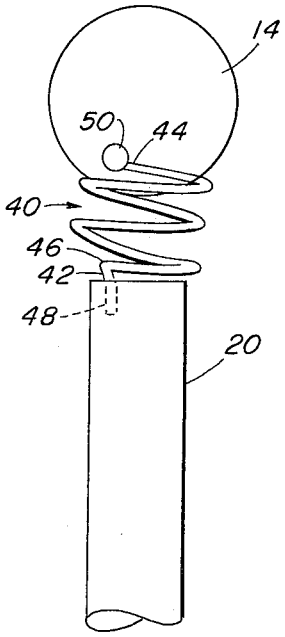
FIG. 5 is a diagram of an embodiment of a center conductor termination fixture having a helical coil to balance the capacitive reactance illustrated in FIGS. 3 and 4.
Figure 1:
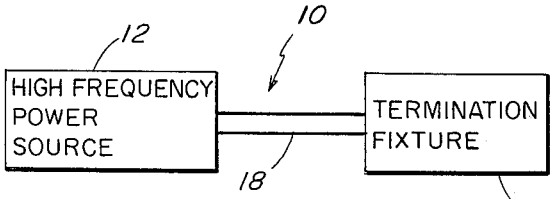
FIG. 1 is a block diagram of an improved electrodeless light source according to the present invention.

In an exemplary embodiment of the present invention, as shown in FIGS. 1, 2 and 5, a light source, indicated by the reference numeral 10, includes a source 12 of power at a high frequency, an electrodeless lamp 14 and a termination fixture 16 coupled to the source, such as by a transmission cable 18. As used herein, the phrase "high frequency" is intended to include frequencies in the range generally from 100 MHz to 300 GHz. Preferably, the frequency is in the ISM band (i.e., industrial, scientific and medical band) which ranges from 902 MHz to 928 MHz. In the embodiment of FIG. 2, the frequency used was 915 MHz. One of many commercially available power sources which may be usd is an Airborne Instruments Laboratory Power Signal Source, type 125. The lamp 14 has an envelope made of a light transmitting substance, such as quartz. The envelope encloses a volatile fill material which produces a light emitting discharge upon excitation. The following are specific examples of lamps and fill materials which may be used.

EXAMPLE I

Fill Material
9.1 mg. of mercury
10 torr of argon
Envelope
Quartz sphere having a 15 mm. ID

EXAMPLE II

Fill Material
8.9 mg. of mercury
1.5 mg. of Sc $I_3$
1.7 mg. NaI
20 torr of argon
Envelope
Quartz sphere having a 15 mm. ID

EXAMPLE III

Another fill material is 2 or 3 atoms of sodium for each mercury atom to yield under operating conditions 200 torr sodium partial pressure and about 1,000 torr mercury partial pressure. The envelope is a material which is resistant to sodium such as translucent $A1_2O_3$.

The fixture 16 (FIG. 2) has an inner conductor 20 and an outer conductor 22 around the inner conductor. In the preferred embodiment, the conductors have a circular cross-section and are located concentrically with respect to each other. The conductors of the fixture have lengths of a quarter wavelength and cross-sectional dimensions selected to produce a fixture characteristic impedance which matches the real portion of the lamp impedance in the excited state to the impedance of the coupled source, assuming the source impedance is a real quantity. In the present embodiment, this is accomplished by making the characteristic fixture impedance equal to $\sqrt{Z_S \cdot R_L}$, where $Z_S$ is the source impedance and $R_L$ is the real component of the lamp impedance during the excited state. For circular conductors, the fixture impedance is a function of conductor diameters:

$$Z = \frac{138}{\sqrt{\epsilon_r/\mu_r}} \log \frac{b}{a}$$

where $\epsilon_r$ = dielectric constant of the medium between the conductors $\mu_r$ = permeability of the medium between the conductors $b$ = inner diameter of the outer conductor $a$ = diameter of the inner conductor.

Figure 3:
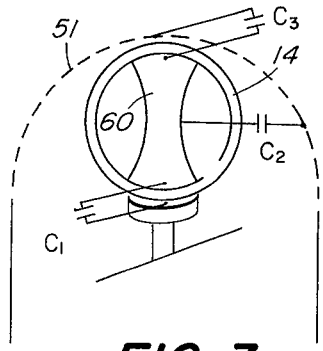
FIG. 3 is a diagram illustrating the various values of capacitance which are associated with the lamp and the fixture during excitation.
Figure 4:
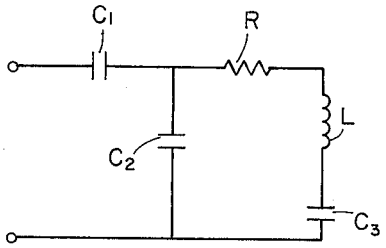
FIG. 4 is a schematic diagram of an equivalent circuit for the lamp at the location of the lamp when the lamp is excited.

Before describing the features of the present invention, it may be helpful to describe some of the electrical effects of lamp excitation with the aid of FIGS. 2 through 4. The method of coupling to the lamp 14 involves placing the lamp at the end of the inner conductor 20 of the termination fixture. The end of the inner conductor 20 may be shaped to receive the lamp, such as is indicated generally by a device 24 in FIG. 2, but the shaping usually does not significantly alter the electrical character of the coupling. It has been found that the lamp 14 placed at the end of the center conductor can, and usually does, form a termination of a complex impedance. FIGS. 3 and 4 illustrate the origin of the complex impedance. A capacitance C1 is coupled from the end of the inner conductor 20 to the arc 28. Since this capacitance C1 is usually dominant, the termination impedance of the lamp during excitation often appears capacitive. A pair of capacitors C3 and C2 are coupled from the arc to the outer conductor 22 via a screen 30.

Referring now to FIG. 4, the equivalent circuit of the termination impedance of the lamp is illustrated in which a resistance R represents the arc resistance. Since it is not possible to achieve a perfect match to a complex impedance using a quarter wavelength line, the quarter wave termination fixture illustrated in FIG. 2 will not provide perfect coupling of high frequency power to the lamp when the lamp has a complex impedance. The lamp may also have a series inductance L.

According to the present invention, the fixture includes a reactive impedance device 40 which is coupled between the end of the inner conductor 20 and the lamp 14. The device 40 is selected to vary the reactive portion of the complex impedance of the lamp in the excited state to enhance the impedance match between the lamp and the source. Preferably, the reactive device 40 has a reactive impedance which cancels the reactive component of the complex impedance of the lamp so that the source and lamp have perfect impedance matching. Since the dominant reactive impedance of the lamp is usually capacitive, the device 40 preferably is inductive. The inductive device 40, as illustrated in FIG. 5, is preferably a helical coil having a first end 42 in contact with the end of the inner conductor 20 and a second end 44 in contact with the lamp 14. In FIG. 5, coil 40 is formed with a bend 46 such that the first end 42 may be positioned in a receiving opening 48 formed in the end of the inner conductor 20. This provides a useful technique for holding the coil in a stationery position with respect to the inner conductor. The second end of the coil may be formed with a spherically shaped element to avoid high field breakdown.

Figure 6:
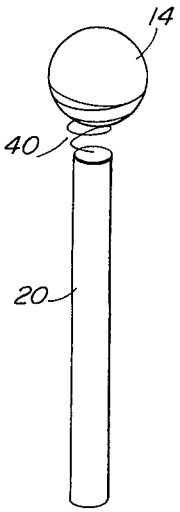
FIG. 6 is a diagram of an alternative embodiment of a helical coil which closes upon itself.
Figure 7:
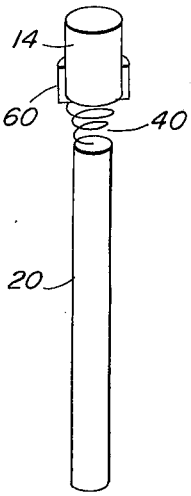
FIG. 7 is a diagram of another alternative embodiment of a helical coil which terminates in a lamp holding device.

There are several possible techniques for suitably holding a lamp stable with respect to the helical coil. First, the second end 44 of the coil 40 may terminate upon another portion of the coil to form a holding fixture for the lamp such as in FIG. 6. Also, a conductive holding element 60 in FIG. 7 may be attached to the second end 44 of the coil for holding the lamp in place. Alternatively, a ceramic adhesive may be used around a portion of the lamp for holding the lamp in place.

The following describes the operation and advantages of this embodiment of the present invention. The helical coil overcomes the imperfect coupling by providing a compensating series inductance. This is done by the use of a short helical extension to the center conductor of the termination fixture. This coil has an inductance as follows:

$$L = \frac{\mu_o N^2 A}{l}$$

where $A$ equals the cross-sectional area of a single turn;

$\mu_o$ is the permeability of free space;

$N$ equals the number of turns; and $l$ equals the length of the coil. In order that the termination impedance be purely real it is necessary that $$L = \frac{X_c}{2\pi f}$$

where $X_c$ is the capacitive reactance of the lamp and $f$ is the frequency of applied high frequency power.

That is, the capacitance of the lamp is exactly compensated by the coil inductance, and the high frequency source impedance may be matched to this termination by the use of a quarter wave termination fixture. There are several advantages to this scheme of coupling. First, this embodiment makes it possible to run lamps with complex impedances quite efficiently. The coil reduces fixture losses since the largest standing waves are confined to the lamp coupler region and it provides a high thermal resistance element by virtue of its length and cross- section, thus reducing heat conduction losses from the lamp.

The primary purpose of the coil at the lamp is to provide some impedance matching for the lamp in the excited state. However, it is a series element in the circuit and so can reduce the applied voltage to the lamp at start-up. At start-up, the load impedance is nearly an open circuit, consisting of only some capacitive coupling from the end of the center conductor to the outside. If the inductance is too high, the voltage drop across the capacitor will be low. In this case, the lamp will not have a sufficiently strong field to produce breakdown.

An approximate upper limit to coil inductance is reached when it equals ~1000 ohms, the calculated capacitive reactance of the center conductor end. For very specific conditions; i.e., Pi ~ 40 watts, helical coil length 1 cm., diameter 0.635 cm., the number of turns is limited to about 3, for reliable starting of mercury/argon lamps with additives. If higher input power is available, or if any of the other variables are changed, the coil could be bigger; i.e., more turns or bigger cross-section.

The embodiments of the present invention are intended to be merely exemplary and those skilled in the art shall be able to make numerous variations and modifications to them without departing from the spirit of the present invention. All such variations and modifications are intended to be within the scope of the present invention as defined in the appended claims.

We claim:

1. A light source including:

a. a source of power at a high frequency, b. an electrodeless lamp having an envelope made of a light transmitting substance and a volatile fill material capable of emitting light upon excitation enclosed within the envelope, and c. a termination fixture coupled to the source, the fixture including an inner conductor and an outer conductor disposed around the inner conductor, the conductors having lengths of a quarter wavelength and cross-sectional dimensions selected to produce a fixture characteristic impedance which matches the real portion of the lamp impedance in the excited state to the impedance of the coupled source, and d. the fixture further including a reactive impedance device coupled between the end of the inner conductor and the lamp, the device being selected to cancel a portion of the reactive part of the complex impedance of the lamp in the excited state, thereby enhancing the impedance match between the lamp and the source.

2. The light source according to claim 1 wherein the dominant reactive impedance of the lamp is capacitive coupling between the end of the inner conductor and the arc within the lamp in the excited state and wherein the reactive impedance device is inductive.

3. The light source according to claim 2 wherein the inductive device includes a helical coil having a first end in contact with the end of the inner conductor and a second end in proximity to the lamp.

4. The light source according to claim 3 wherein the coil is formed with a bend such that the first end may be positioned in a receiving opening formed in the end of the inner conductor.

5. The light source according to claim 3 wherein the helical coil is made of tungsten.

6. The light source according to claim 3 wherein the second end of the coil is terminated with a spherically-shaped element to avoid high field breakdown.

7. The light source according to claim 3 wherein the second end of the coil terminates upon another portion of the coil to form a holding fixture for the lamp.

8. The light source according to claim 3 further including a conductive, cup-shaped member attached to the second end of the coil for holding the lamp in place.

9. The light source according to claim 3 further including a ceramic adhesive for holding the lamp stable with respect to the second end of the coil.

* * * * *

UNITED STATES PATENT OFFICE

CERTIFICATE OF CORRECTION

Patent No. 3,943,404 Dated March 9, 1976

Inventor(s) William Henry McNeill et al.

It is certified that error appears in the above-identified patent and that said Letters Patent are hereby corrected as shown below:

Column 1, line 32, delete "Fehsenfield" and insert

-- Fehsenfeld --.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*